US011437732B2

(12) United States Patent
Mccordic et al.

(10) Patent No.: US 11,437,732 B2
(45) Date of Patent: Sep. 6, 2022

(54) MODULAR AND STACKABLE ANTENNA ARRAY

(71) Applicant: RAYTHEON COMPANY, Waltham, MA (US)

(72) Inventors: Craig H. Mccordic, Medfield, MA (US); Joseph R. Ellsworth, Worcester, MA (US); Douglas J. Moriondo, Shrewsbury, MA (US); Joseph Angelo DelGenio, Marlborough, MA (US); Christopher Robert White, Framingham, MA (US); Adam Carl Rickis, Milford, MA (US); Caroline Margaret Manteiga, North Andover, MA (US)

(73) Assignee: Raytheon Company, Waltham, MA (US)

( * ) Notice: Subject to any disclaimer, the term of this patent is extended or adjusted under 35 U.S.C. 154(b) by 97 days.

(21) Appl. No.: 16/573,954

(22) Filed: Sep. 17, 2019

(65) Prior Publication Data

US 2021/0083399 A1 Mar. 18, 2021

(51) Int. Cl.
*H01Q 21/00* (2006.01)
*H01Q 1/02* (2006.01)
(Continued)

(52) U.S. Cl.
CPC ..... *H01Q 21/0025* (2013.01); *H01Q 1/02* (2013.01); *H01Q 1/405* (2013.01); *H01Q 21/22* (2013.01)

(58) Field of Classification Search
CPC ..... H01Q 21/0025; H01Q 1/02; H01Q 1/405; H01Q 21/22
See application file for complete search history.

(56) References Cited

U.S. PATENT DOCUMENTS 4,816,835 A * 3/1989 Abiko ..... H01Q 21/0075 343/700 MS
5,099,254 A * 3/1992 Tsukii ..... H01Q 1/002 343/853

(Continued)

FOREIGN PATENT DOCUMENTS

CN 106374236 A 2/2017
EP 1 764 863 A1 3/2007

OTHER PUBLICATIONS

International Search Report for corresponding International Application No. PCT/US2020/049268, filed Sep. 3, 2020, International Search Report dated Nov. 2, 2020 and dated Nov. 10, 2020 (5 pgs.).

(Continued)

*Primary Examiner* — Dimary S Lopez Cruz
*Assistant Examiner* — Bamidele A Jegede
(74) *Attorney, Agent, or Firm* — Lewis Roca Rothgerber Christie LLP

(57) ABSTRACT

A modular phased array antenna that includes a plurality of modular antenna array blocks assembled together as a single antenna array and an array face having an array plate and a radiator and radome assembly for each modular block interlocked and aligned to create a single monolithic array face. Each modular antenna array block includes: a plurality of transmit/receive integrated multichannel module (TRIMM) cards, each TRIMM card including power and beamforming signals, where power and beamforming signals are connected in parallel to each modular antenna array block, a plurality of radiators for radiating antenna signals having a radiator face, a radome integrated with the plurality of radiators and interfacing directly to the radiator face, where the radome does not extend beyond the radiator face, and a frame for supporting the TRIMM cards.

20 Claims, 16 Drawing Sheets

(51) Int. Cl.
*H01Q 1/40* (2006.01)
*H01Q 21/22* (2006.01)

(56) References Cited

U.S. PATENT DOCUMENTS 5,223,850 A * 6/1993 Branigan ..... H01Q 25/02 343/771
5,276,452 A * 1/1994 Schuss ..... H01Q 3/26 342/373
5,327,152 A * 7/1994 Kruger ..... H01Q 21/0087 343/853
5,412,414 A * 5/1995 Ast ..... G01S 7/4017 342/174
5,666,128 A * 9/1997 Murray ..... H01Q 21/0087 343/878
5,724,048 A * 3/1998 Remondiere ..... H01Q 1/288 343/700 MS
5,854,607 A * 12/1998 Kinghorn ..... H01Q 21/0087 343/853
6,703,976 B2 * 3/2004 Jacomb-Hood ..... H01Q 1/288 342/373
7,042,393 B1 * 5/2006 Konapelsky ..... G01S 3/043 342/372
7,369,085 B1 * 5/2008 Jacomb-Hood .... H04B 7/18515 342/374
7,889,147 B2 2/2011 Tam et al.
8,564,494 B2 * 10/2013 Turner ..... H01Q 21/26 343/810
8,810,448 B1 * 8/2014 Ellsworth ..... G01S 7/02 361/699
9,116,222 B1 * 8/2015 Ellsworth ..... H01Q 1/02
9,172,145 B2 10/2015 Puzella et al.
9,379,438 B1 * 6/2016 Runyon ..... H01Q 1/523
2003/0067410 A1 * 4/2003 Puzella ..... H01Q 21/0087 343/700 MS
2003/0156060 A1 * 8/2003 Revankar ..... G01S 7/032 342/372
2005/0110681 A1 * 5/2005 Londre ..... H01Q 1/246 343/700 MS
2006/0132372 A1 * 6/2006 Jung ..... H01Q 21/061 343/757
2008/0029480 A1 * 2/2008 Pruett ..... H01Q 21/062 216/58
2008/0150832 A1 * 6/2008 Ingram ..... H01Q 25/00 343/893
2008/0169973 A1 * 7/2008 Pluymers ..... H01Q 1/02 342/368
2008/0204350 A1 * 8/2008 Tam ..... H01Q 21/0025 343/872
2008/0225485 A1 * 9/2008 Altman ..... H01Q 21/0025 361/699
2008/0316101 A1 * 12/2008 Brown ..... H03F 3/24 342/374
2009/0027268 A1 * 1/2009 Coward ..... H01Q 3/22 342/375
2010/0099370 A1 * 4/2010 Nichols ..... H01Q 21/20 455/129
2010/0157531 A1 * 6/2010 Mason ..... H01Q 1/02 361/697
2012/0139786 A1 * 6/2012 Puzella ..... H01Q 1/3216 342/368
2012/0194406 A1 * 8/2012 Brown ..... H01Q 5/42 343/876
2012/0319901 A1 * 12/2012 Pruett ..... H01Q 3/26 342/372
2013/0074520 A1 * 3/2013 Wyatt ..... F25B 21/02 62/3.2
2013/0319901 A1 * 12/2013 Wei ..... F16L 9/04 206/524.6
2015/0015453 A1 * 1/2015 Puzella ..... H05K 1/0206 333/1.1
2015/0188236 A1 * 7/2015 Oppenlaender ..... H01Q 15/24 343/776
2015/0303586 A1 * 10/2015 Hafenrichter ..... H01Q 21/0025 343/873
2015/0372394 A1 * 12/2015 Crockett, Jr. ..... H01Q 3/24 343/700 MS
2015/0380802 A1 * 12/2015 Newkirk ..... B01L 3/0286 343/879
2016/0329630 A1 * 11/2016 Mustajarvi ..... H01Q 1/246
2017/0005416 A1 * 1/2017 Gendron ..... H01Q 9/0407
2017/0085005 A1 * 3/2017 Aue ..... H03F 3/24
2018/0219277 A1 * 8/2018 Hirata ..... H01Q 1/246
2018/0219281 A1 * 8/2018 Sudo ..... H01Q 1/405
2018/0288909 A1 * 10/2018 Wasniewski ..... H05K 9/0015
2018/0366837 A1 * 12/2018 Fox ..... H01Q 5/42
2019/0021191 A1 * 1/2019 Jones ..... G06F 1/1656
2019/0123443 A1 * 4/2019 Russell ..... H01Q 1/1207

OTHER PUBLICATIONS

Written Opinion of the International Searching Authority for corresponding International Application No. PCT/US2020/049268, filed Sep. 3, 2020, Written Opinion of the International Searching Authority dated Nov. 10, 2020 (12 pgs.).

* cited by examiner

MODULAR AND STACKABLE ANTENNA ARRAY

FIELD OF THE INVENTION

The present invention relates generally to phased array antenna design and more specifically to modular and stackable phased array antennas.

BACKGROUND

An antenna array is a group of multiple connected antennas coupled to a common source or load to act as a single antenna and produce a directive radiation pattern. Usually, the spatial relationship of the individual antennas also contributes to the directivity of the antenna array. FIG. 1 shows a diagram of a conventional antenna array 100. The antenna array 100 includes several linear arrays 104 housed in a (non-metallic) radome 102. Here, each linear array 104 is arranged vertically with equal spacing between each other, which is determined by the wavelength of the desired operating frequency of the antenna array 100. Each linear array 104 is connected to its associated radio frequency (RF) electronics circuitry contained in an external RF electronics module 108, via an antenna feed 106. The RF electronics module 108 is connected to external systems via a connection 110 for power, control, and communications connections; and may be physically mounted within the radome 102, or may be located remotely or outside of the antenna array 100.

An Electronically Scanned Array (ESA) is a type of phased array antenna, in which transceivers include a large number of solid-state transmit/receive modules. In ESAs, an electromagnetic beam is emitted by broadcasting radio frequency energy that interferes constructively at certain angles in front of the antenna. An active electronically scanned array (AESA) is a type of phased array antenna whose transmitter and receiver (transceiver) functions are composed of numerous small solid-state transmit/receive modules (TRMs) or components. AESA antennas aim their beam by emitting separate radio waves from each module that are phased shifted or time delayed so that waves interfere constructively at certain angles in front of the antenna.

Typically, the basic building block of a conventional AESA is the Transmit/Receive module or TR module, which can be packaged to form an AESA antenna element, and may include a radiator, receiver Low Noise Amplifier (LNA), transmit Power Amplifier (PA), and digitally controlled phase or delay and gain components. Several of these TR modules are placed on antenna panels in a grid format for transmitting and receiving radar signals. Digital control of the transmit/receive gain and phase allows an AESA antenna to steer or point the resultant antenna beam without physically moving the antenna panel. Typical modern day low cost AESA antenna panels employ printed circuit radiators connected to surface mount Monolithic Microwave Integrated Circuit (MMIC) devices that contain the LNA, PA and phase/gain control circuitry, all on a single printed circuit board (PCB).

Typically, antenna arrays are designed in a platform or housing that must be sized for frequency and gain by changing the structural elements of the platform. For example, larger antenna elements are needed for lower frequencies and smaller antenna elements are required for higher frequencies, while increasing the number of antenna elements is necessary to increase the antenna gain. However, the antenna platform is generally a fixed structure and typically cannot be modified to accommodate such changes or improvements in the design and therefore is not capable of easy adjustment of the frequency range and gain since they are generally fixed in the structure. Additionally, since these antenna arrays are specifically built for the specified frequency, gain, polarization, beam width, and other requirements, the lead time to make any design changes or performance improvements is very long.

FIG. 2 illustrates a typical architecture of a conventional radar antenna array. As shown, a plurality of power and beamforming building blocks 204/206 are arranged in an array 200 in rows and columns. Each Modular Building Block (MBB) 206 may include a number of transmit/receive integrated multichannel module (TRIMM) cards and their associated power and signals electronics cards including, for example 24 TRIMMs, a synthesizer card, a DREX (Digital Receiver Exciter) card, and an auxiliary power controller card. In these architectures, each individual TRIMM card may be replaceable as well as the architecture may be modular at the modular building block, in this example, 24 Line Replaceable Unit (LRU) level. As a result, these designs require new unique array structure and back structure for each radar size and performance and cannot be easily upgraded in size at a later date without extensive rework. The power and beamforming network for each LRU block (of 24 TRIMMs) would require extensive modification to the existing power, signal and thermal management systems to add additional modular building blocks to a previously existing antenna system.

Moreover, these architectures feature structure, support electronics and thermal management subsystems that extend beyond the active antenna area and to the edges 202 of the array and thus are not amenable to adding additional array building blocks without extensive redesign.

Since these conventional antenna architectures have structure and supporting electronics that extend beyond the active region of the antenna, this makes it impractical to stack one antenna on top of, or next to, another because it would create a disruption in the radiating element lattice pattern that would negatively impact radar performance. In addition, in many legacy systems the power and beamforming overlap from one building block to another, making it impossible to stack antennas. Consequently, the structure, interconnects, and thermal management infrastructure need to be extensively redesigned to change the size of the antenna.

SUMMARY

In some embodiments, the disclosed invention is a modular phased array antenna that includes a plurality of modular antenna array blocks assembled together as a single antenna array and an array face having an array plate and a radiator and radome assembly for each modular block interlocked and aligned to create a single monolithic array face. Each modular antenna array block includes: a plurality of transmit/receive integrated multichannel module (TRIMM) cards, each TRIMM card including power and beamforming signals, where power and beamforming signals are connected in parallel to each modular antenna array block, a plurality of radiators for radiating antenna signals having a radiator face, a radome integrated with the plurality of radiators and interfacing directly to the radiator face, where the radome does not extend beyond the radiator face, and a frame for supporting the TRIMM cards.

In some embodiments, the disclosed invention is a modular phased array antenna that includes a plurality of modular antenna array blocks assembled together as a single antenna array. Each modular antenna array block includes: a plurality of transmit/receive integrated multichannel module (TRIMM) cards, each TRIMM card including power and beamforming signals, where power and beamforming signals are connected in parallel to each modular antenna array block, a plurality of radiators for radiating antenna signals having a radiator face, a radome integrated with the plurality of radiators and interfacing directly to the radiator face, where the radome does not extend beyond the radiator face, and a frame for supporting the TRIMM cards. Moreover, each modular antenna array block contains its own power and electronics cards and is capable of being configured as a stand-alone radar antenna array In some embodiments, each modular antenna array block receives cooling independent with respect to cooling of other modular antenna array blocks, In some embodiments, the frame is made of aluminum and attaches to a back structure made of steel on its back side, and each modular antenna array block further comprises an intermediate aluminum frame between the frame and the back structure to minimize array face distortion due to coefficient of thermal expansion.

In some embodiments, each modular antenna array block further comprises a plurality of adjustment mechanisms located at corners of said each modular antenna array building block for adjustment of said each modular antenna array building block in six degree of freedom.

In some embodiments, each modular antenna array block may further include threaded bosses along vertical sides and bottom of the frame for allowing said each modular antenna array block to be securely fastened to every adjacent modular antenna array block and/or a plurality of actuators configured to adjust a position of said each modular antenna array block.

BRIEF DESCRIPTION OF THE DRAWINGS

These and other features, aspects, and advantages of the present invention will become better understood with regard to the following description, appended claims, and accompanying drawings.

DETAILED DESCRIPTION

Figure 3:
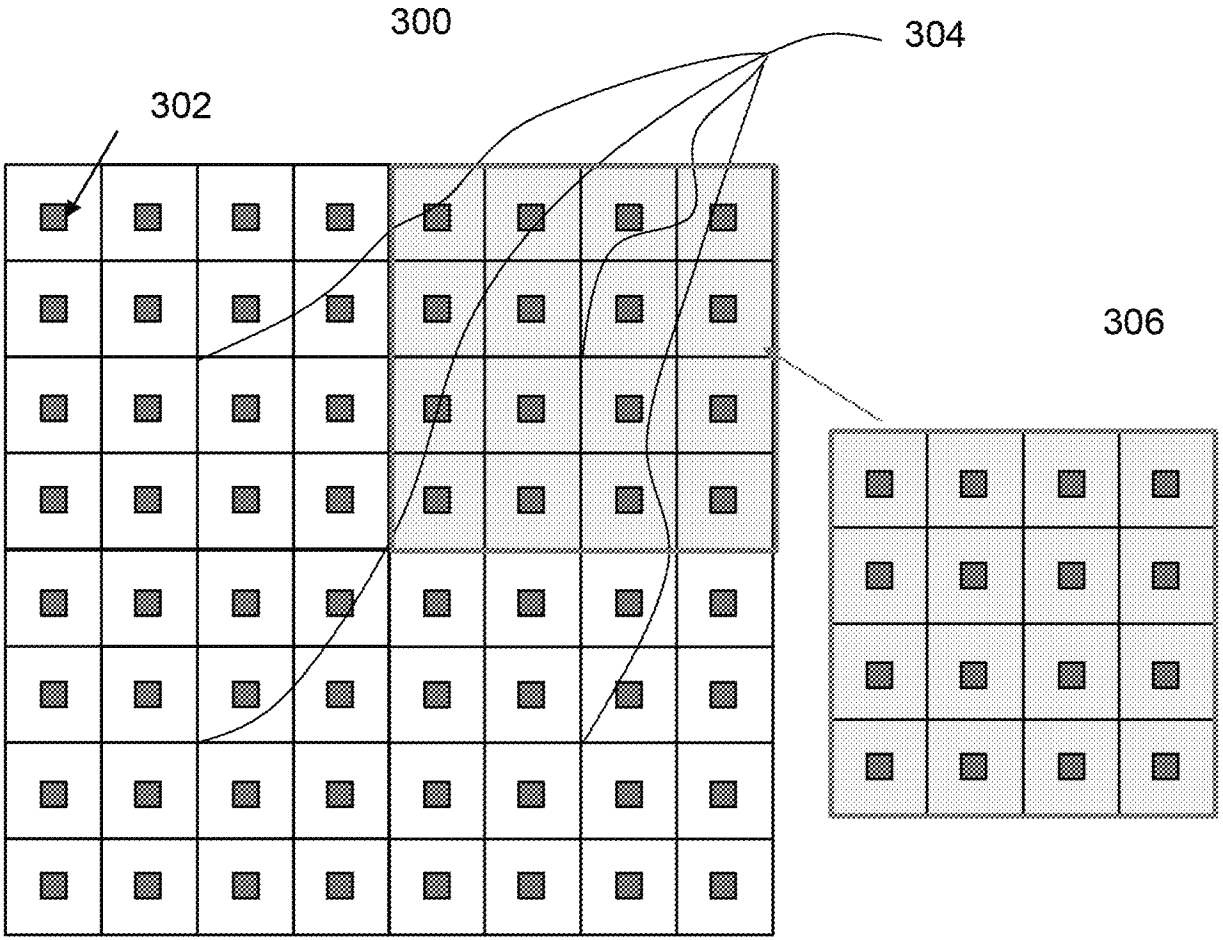
FIG. 3 depicts an exemplary architecture of a modular and stackable antenna array, according to some embodiments of the disclosed invention.

In some embodiments, the disclosed invention is one or more of a modular and stackable antenna. FIG. 3 depicts an architecture of a modular and stackable antenna array 300, according to some embodiments of the disclosed invention. As shown, the antenna array 300 includes four modular and stackable antenna array blocks 306. Each modular and stackable antenna array block 306 includes a plurality of antenna elements (for example, 302), as shown by the modular block 306). Each modular and stackable antenna array building block 306 may include a number of transmit/receive integrated multichannel module (TRIMM) cards and their associated power and signals electronics cards that is a fully functional stand-alone radar antenna array, with its own self-supporting structure.

In some embodiments, the modular antenna structure and supporting electronics 302 reside within the volume behind the active antenna region 306, allowing one antenna array block to be stacked on top of, or next to, another antenna array block to create a single, larger monolithic antenna with no disruption of antenna array's lattice spacing. Power, cooling and beamforming 304 are connected in parallel to each modular antenna array block and therefore, eliminating the dependency of one antenna array block on the adjacent antenna array block. In other words, each building block receives coolant, power, and control signals in parallel and thus the power and beamforming circuitries are internal to each block, which eliminates any beamforming RF interconnections between modular building blocks.

The modular and stackable antenna blocks may be combined (e.g. stacked on, or placed next to) together to produce any desired size antenna array 300 and thus minimizing the initial investment costs while maintaining the ability to easily increase the size and sensitivity and thus capability of the antenna array, as required by different applications. Each modular and stackable antenna block operates the same regardless of the assembled array size. This way, additional antenna blocks can be added later without impact to the existing system's structure, support electronics or thermal management.

Figure 4:
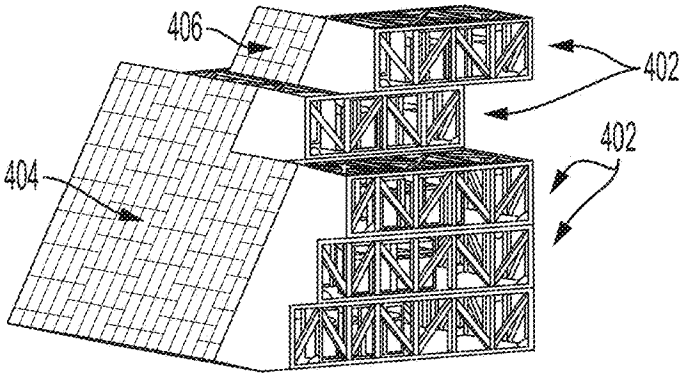
FIG. 4 shows multiple Modular Radar Assemblies (MRA) assembled together as a single radar antenna array, according to some embodiments of the disclosed invention.

FIG. 4 shows multiple Modular Radar Assemblies (MRA) assembled together as a single radar antenna array 400, according to some embodiments of the disclosed invention. As shown, each MRA 402 has the same structures and operates the same way as the other MRAs resulting in the single antenna array 400, which is modular and scalable at the antenna building block level. In some embodiments, the array structure for the overall single antenna array 400 is comprised of the structure inherent in each basic MRA building block's structure and therefore no additional structure is required to assemble the MRA building blocks 402 to create the single antenna array 400. Moreover, each MRA receives cooling, power and control signals in parallel (with respect to other MRAs). The array face 404 is created by aligning the faces of each MRA 406, using the alignment features inherent in each MRA structure 402, to create a single uniform antenna array face.

Figure 5:
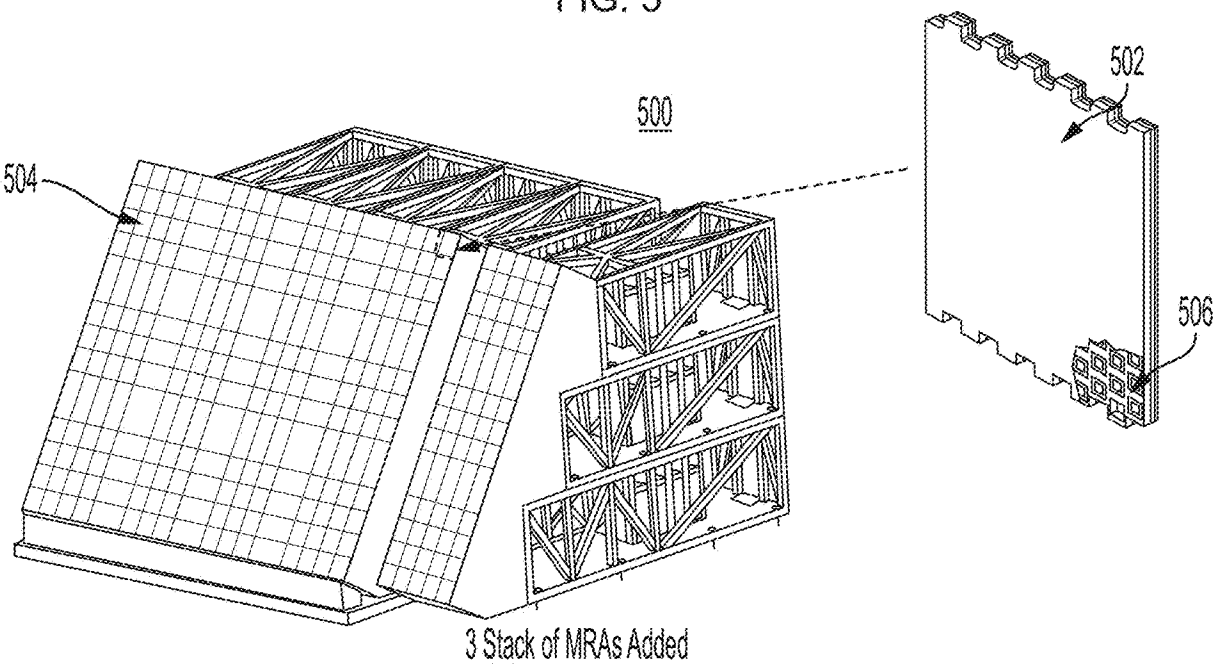
FIG. 5 illustrates a modular and stackable antenna array with a radome cutaway view, according to some embodiments of the disclosed invention.

FIG. 5 illustrates a modular and stackable antenna array 500 with a radome cutaway view, according to some embodiments of the disclosed invention.

As shown, the modular and stackable antenna array 500 utilizes a new radome design that is integrated with (part of) the radiator 506 within each modular building block. Unlike radome designs that have structural attachments that extend beyond the active face of the array, the new radome design of the disclosed invention interfaces directly to the radiator face 506 for each MRA (three MRAs are shown separated here) and fits within the MRA's lattice spacing, so the MRAs can be stacked or placed adjacent to each other without impacting the overall array's lattice spacing or RF performance The integrated radome 502 is the same size as radiator assembly 506 comprising of multiple radiating elements and attaches directly to the radiator assembly, rather than attaching to extra structure around the perimeter of the radiator. The integrated radome allows the array structure to be the same size as the active array face 504, rather than extending beyond the edges of the face. Since the MRA structure does not extend beyond active area of the array face 504, the modular building blocks can be stacked with no interruptions in the block spacing between adjacent stacked modular building blocks. All modular building blocks can operate the same way regardless of the array size.

Figure 1:
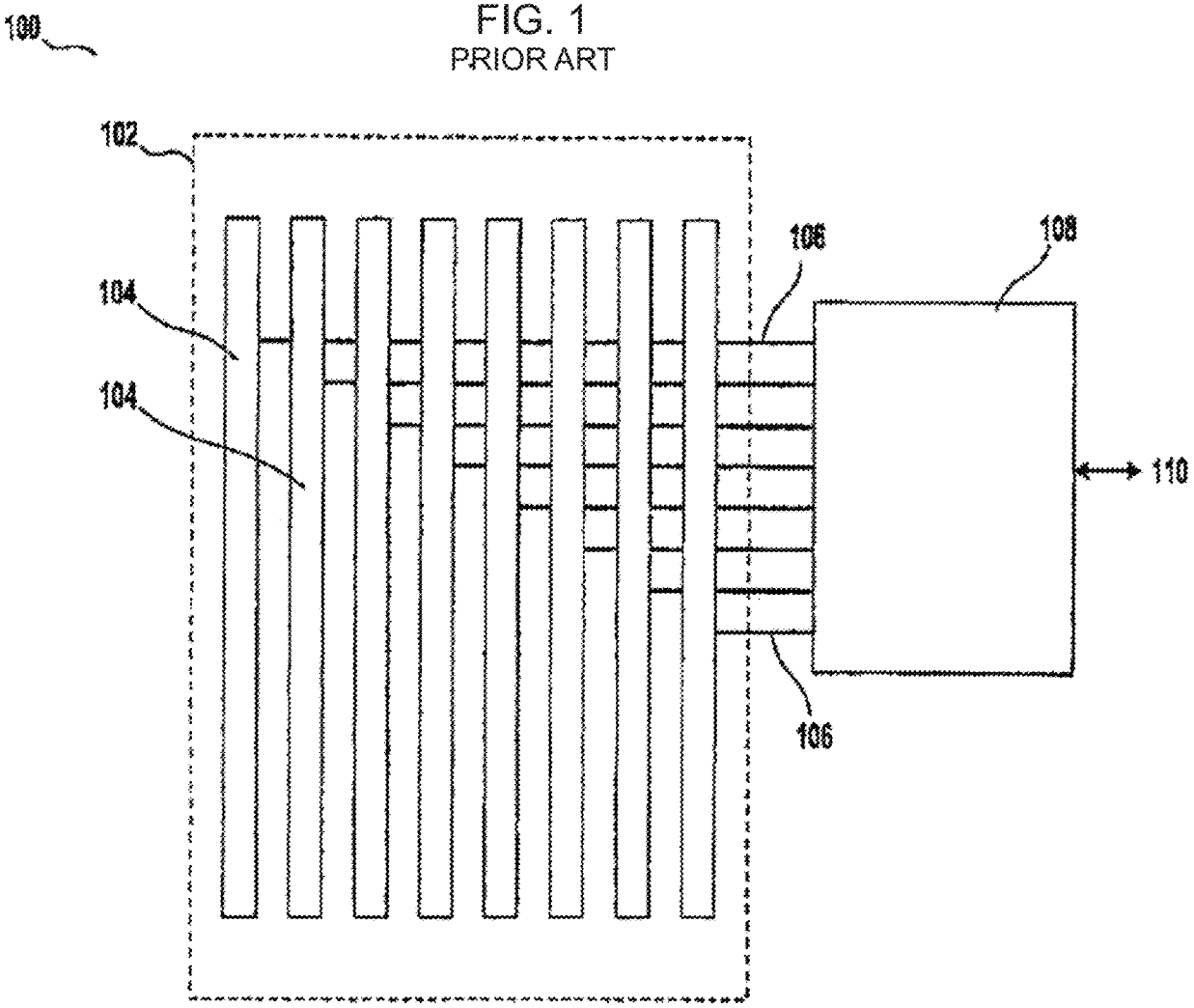
FIG. 1 PRIOR ART
FIG. 1 shows a diagram of a conventional antenna array.
Figure 2:
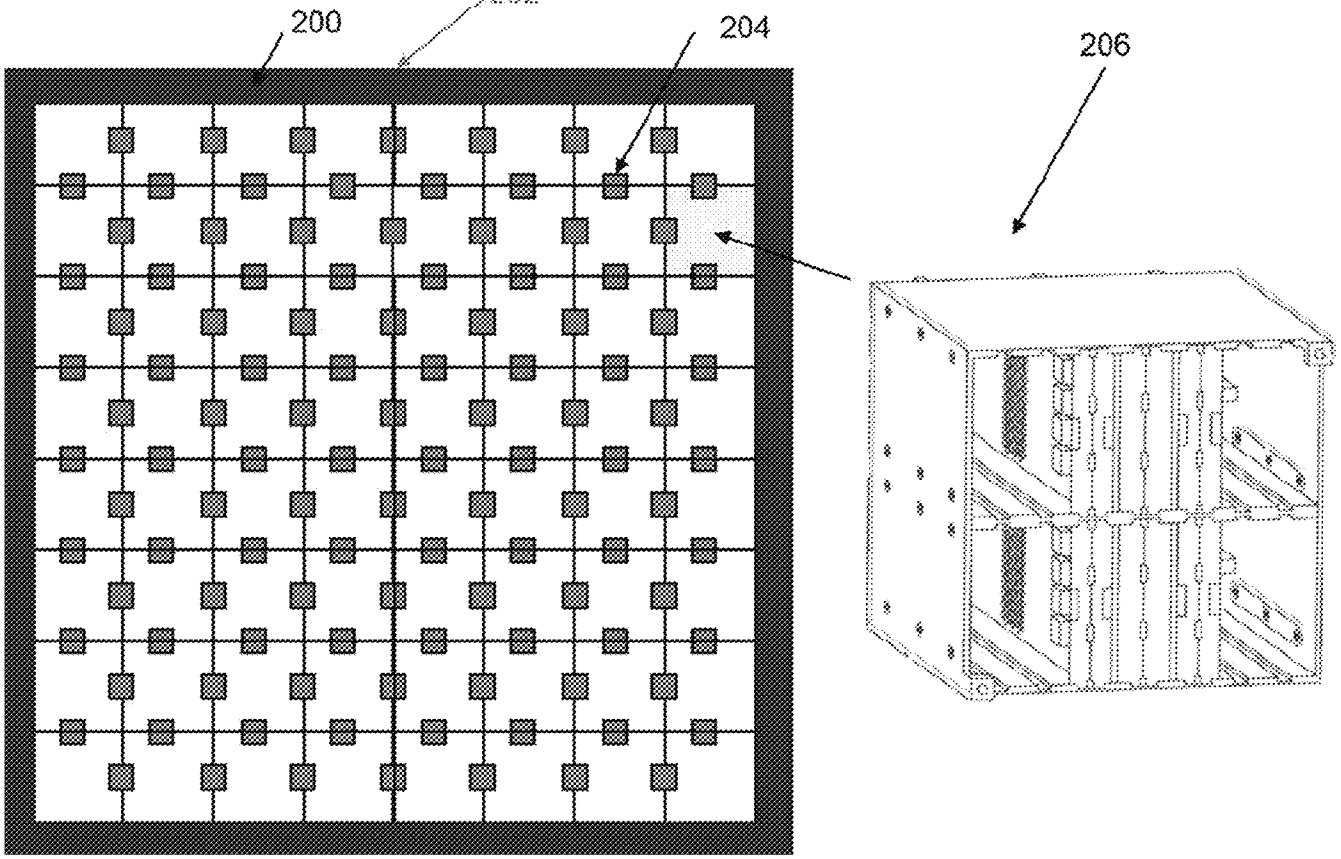
FIG. 2 PRIOR ART
FIG. 2 illustrates a typical architecture of a conventional radar antenna array.

In contrast, many conventional antenna arrays use a radome that is independent of the radiators and therefore the radome assembly bolts to structure and extends beyond the edges of the active radiating area, as shown in FIG. 2. Because the structure needs to extend well beyond the active radiating area, when one array is stacked on top of another, it results in a large gap between the active elements in one array and the active elements in the other array. The integral radome allows for the modular stacking approach with no interruptions in the unit cell spacing between adjacent stacked modular building blocks, which is detrimental to the RF performance of the system.

Figure 6A:
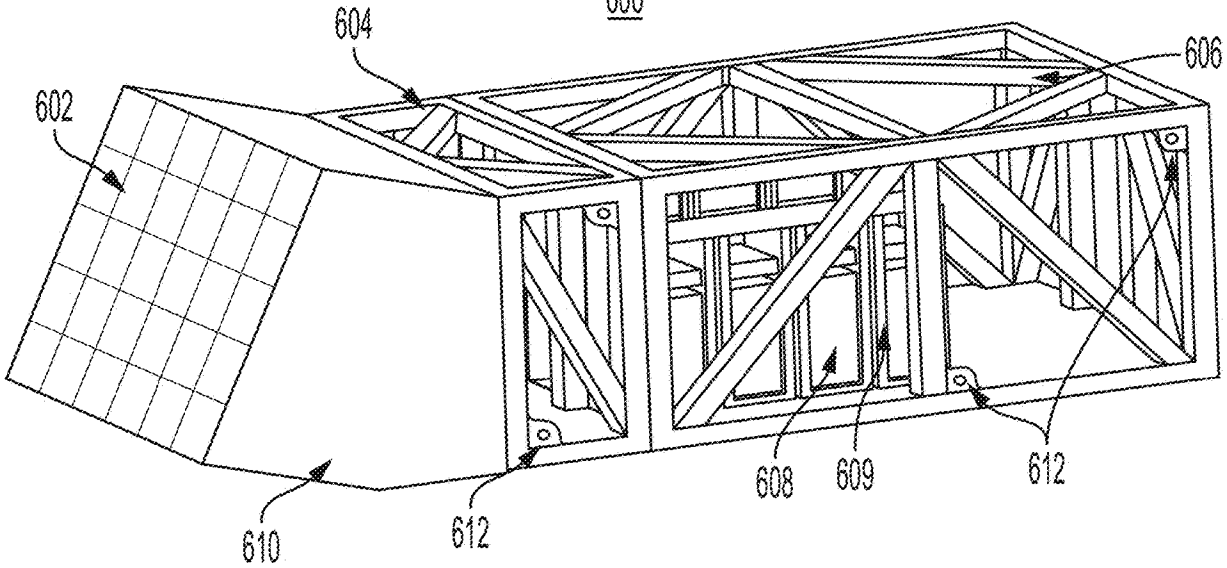
FIGS. 6A, 6B and 6C depict a building block of a modular and stackable antenna array, according to some embodiments of the disclosed invention.
Figure 6B:
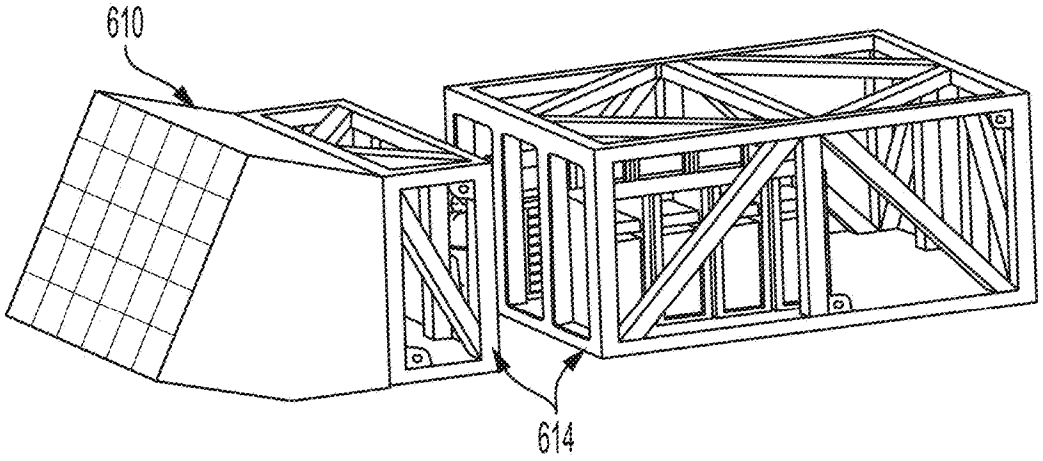
Figure 6C:
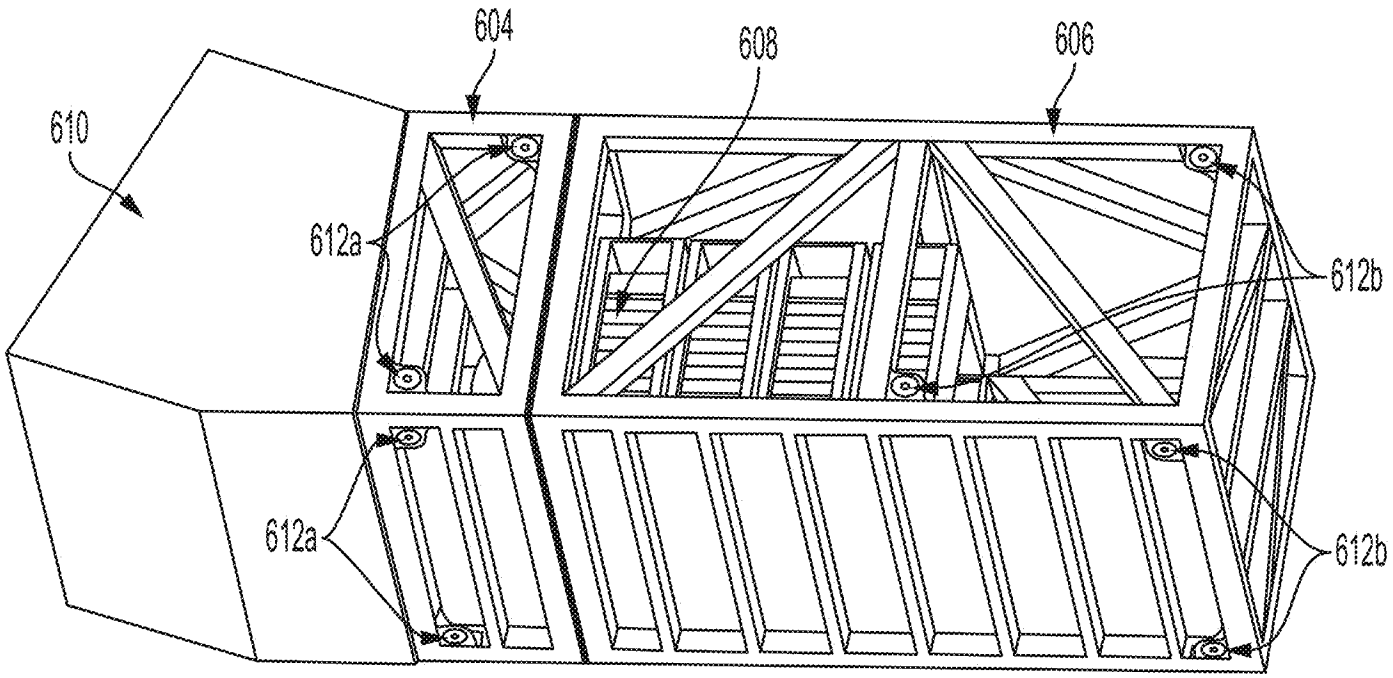

FIGS. 6A, 6B and 6C depict a building block 600 of a modular and stackable antenna array, according to some embodiments of the disclosed invention. The building block 600 contain all of the antenna's electronic hardware and functionality including the radiators, beamformers, TRIMMs, DREXs, and AC/DC power conversion. These building blocks operate in parallel and are standalone (smaller) radars that can be added together to adjust the radar's sensitivity, performance and size. Therefore, in contrast to the conventional antenna array systems, the DREX are distributed in the modular and stackable radar antenna array. In this example, the antenna array building block 600 includes 30 MBBs 602 at its radar face. A structural frame 604 supports and aligns the 30 MBBs 602 and interfaces to the back structure 606. In some embodiments, the frame 604 is made of aluminum to address thermal expansion issues between the array face 602 and the rest of the system. A back structure 606, typically made of steel, provides additional support to the MBBs, and provides a location for the back end electronics 608 and thermal management systems used to drive each modular building block 600.

In some embodiments, to minimize array face distortion due to coefficient of thermal expansion (CTE) mismatch between aluminum frame 610 and steel back structure 606, an intermediate aluminum frame 604 mates between the two. This intermediate structure acts as a deflection buffer for the array face, where the intermediate frame is configured and mounted in such a fashion to deflect as much as needed during thermal expansion without transferring these deflections to the array face, which can impact system performance. The antenna's electronic hardware and functionality including the radiators, beamformers, TRIMMs, DREXs, and AC/DC power conversion 608 are accommodated in a modular and easily replaceable rack 609. A plurality of adjustment mechanisms 612 located at the corners of the modular building block 600 allow adjustment of the building block in six degree of freedom. A flanged interface 614 provides the physical interface between the (front) frame and back structures, while allowing access forward to the MBB housing 610 which supports and aligns the MBBs to access each individual MBB for maintenance.

The radar building blocks 600 may be stacked vertically and/or horizontally to form a larger radar array face, by a plurality of forward adjustment/alignment mechanisms 612*a* and aft rear adjustment mechanisms 612*b*. In some embodiments, the disclosed invention, utilizes a unique 3-dimensional (3D) alignment mechanisms for installing each antenna module. The 3D alignment mechanisms 612*a* and 612*b* located at each corner of the back structure allow adjustments in all six degrees of freedom, (x, y, z & rotational) to ensure proper positioning. Section alignment may be performed manually or automated.

Figure 7:
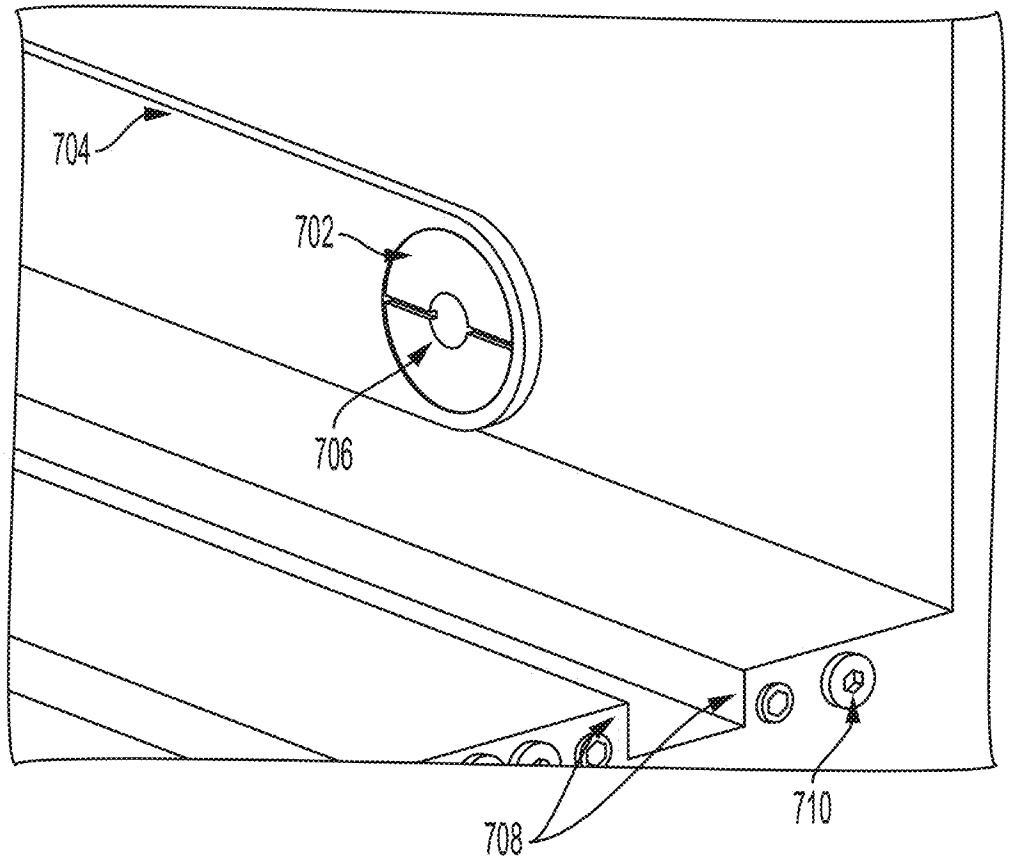
FIG. 7 shows an exemplary fastener for a modular and stackable antenna array block assembled together, according to some embodiments of the disclosed invention.

FIG. 7 shows an exemplary fastener for a modular and stackable antenna array block assembled together, according to some embodiments of the disclosed invention. As shown, each radar building block has threaded bosses 702 along the vertical sides of the structural MBB housing/frame 704 and along its bottom. The threaded bosses 702 allow each radar building blocks to be securely fastened to each other while eliminating tolerance build-up across the array face. In some embodiments, threaded bosses 702 are rotated until snug against the adjacent radar building block's structural MBB housing 704 and a bolt 710 is placed thru the center hole 706 in the boss 702 and threaded into its neighboring radar building block to securely attach each radar building block to every adjacent building block at edges 708.

Figure 8A:
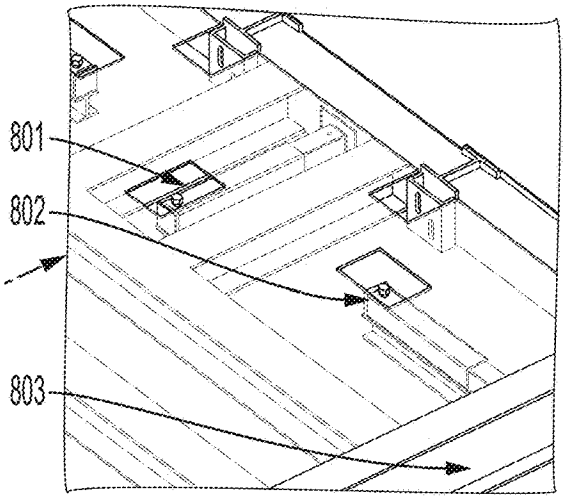
FIGS. 8A, 8B and 8C show a number of exemplary actuators to position the stacked MRA relative to the base MRA, according to some embodiments of the disclosed invention.
Figure 8B:
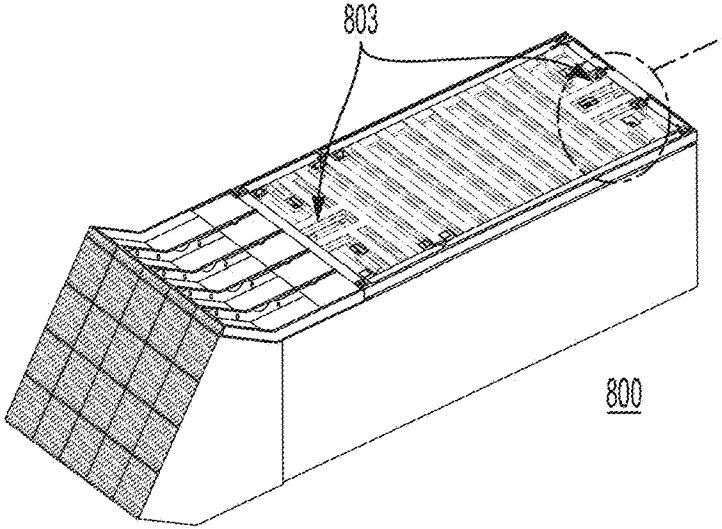
Figure 8B:
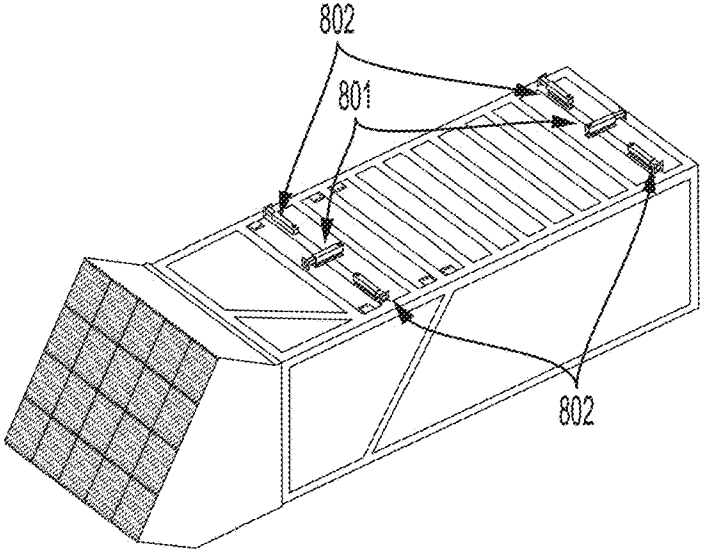
Figure 8C:
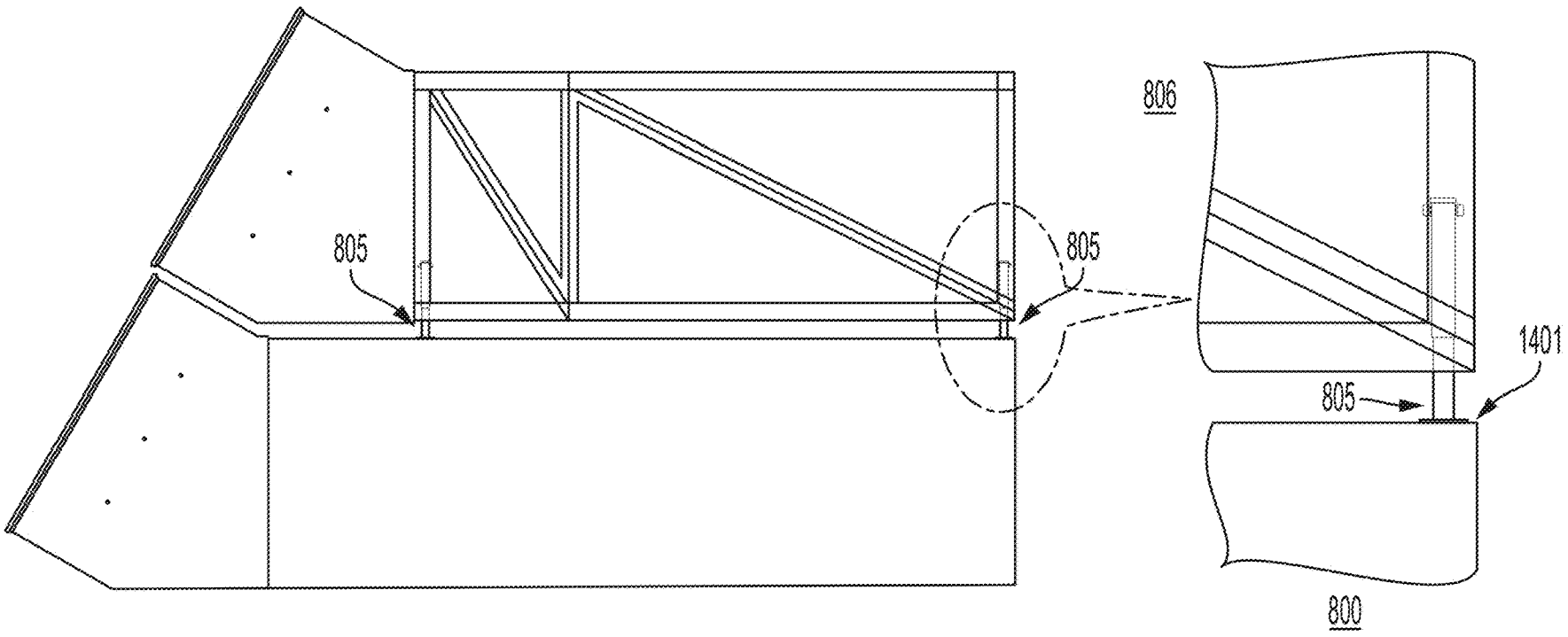

FIGS. 8A, 8B and 8C show a number of actuators utilized for manipulation of the stacked MRA within the XY plane, and the Z plane, according to some embodiments of the disclosed invention. As shown, two actuators 801 (e.g., jacks) are located along the spine of the base MRA 800 to adjust position along the y-axis. Four jacks 802 are located perpendicular to the side walls of the MRA to adjust position along the x-axis and mitigate unsolicited moment induction about the center of gravity. The jacks are fastened to surfaces that are welded to the roof of the lower MRA. By extending the horizontally fixed jacks, the stacked MRA is moved. Four jacks, 805 shown in FIG. 8C are vertically mounted to raise and lower the stacked MRA during the alignment procedure. Delrin pads between the vertical jacks and the MRA enable the stacked MRA to slide easily along the XY plane.

As shown in FIG. 8A, floor joists 803 of the MRA are oriented to not interfere with the jacks during the alignment procedure. The layout of the floor and actuators (e.g., jacks)

enable ease of access while also maintaining the structural integrity of the MRA. In some embodiments, the perimeters of the MRA back structures are made with square tube stock as opposed to W-flange beams in order to provide the jack foot a large surface area to react against. Also, as shown in FIG. 8C, pads 1401 (described in more detail in FIG. 14) are mounted to facilitate sliding of one MRA 800 relative to another 806.

Figures 9A, 9B:
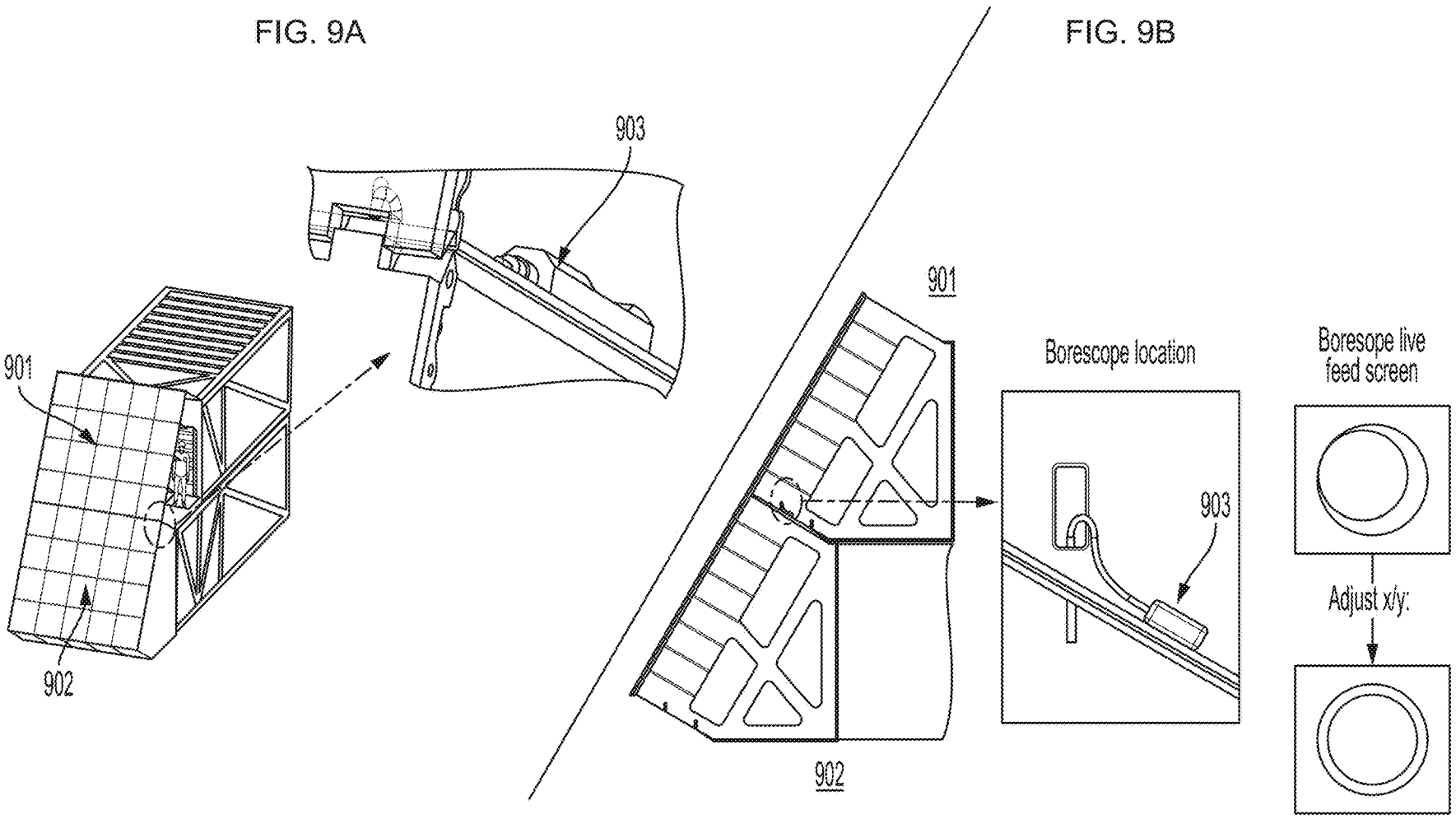
FIGS. 9A and 9B illustrate a borescope as a guide for alignment of the MRAs, according to some embodiments of the disclosed invention.
Figure 10B:
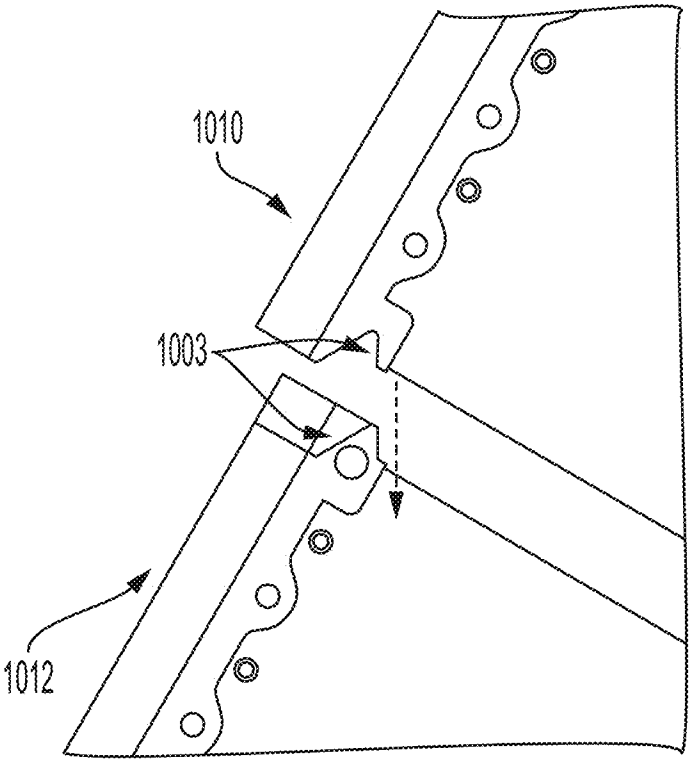
FIGS. 10A and 10B show the interlocking joint in an array plate 800 with mounted radiators, according to some embodiments of the disclosed invention.
Figure 10A:
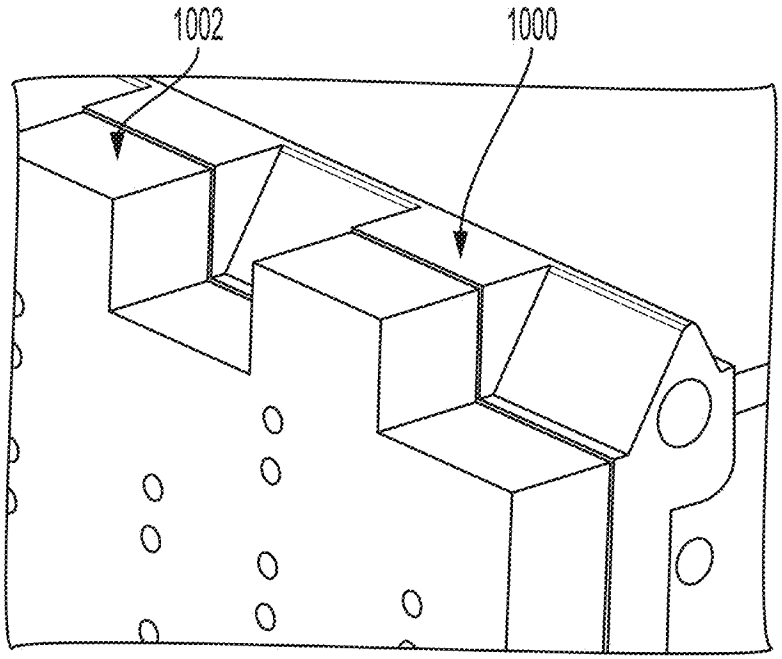

FIGS. 9A and 9B show an application of a borescope for alignment, according to some embodiments of the disclosed invention. As illustrated, a borescope's lens housing is threaded into a hole in the top MRA 901 that is concentric with a target hole in the bottom MRA 902. When the MRAs are misaligned, the holes are not concentric. Adjustments can be made the MRA position until the upper and lower holes are concentric. The live video is then viewed from a remote monitor, for example, with a Bluetooth borescope 903. An operator can use that imagery to align the stacked MRA by manipulating the appropriate jacks until the image shows concentric circles between the borescope and the target hole on the base MRA, as illustrated in FIG. 9B FIGS. 10A and 10B show interlocking joints in an array plate 1000 with mounted radiators 1002, according to some embodiments of the disclosed invention. The array plate 1000 is attached to the front of the antenna array, between the radiators and the antenna electronic hardware. The joints 1003 positioned in the top and bottom of the array plate are made up of a combination of features that allow for adjustment to achieve alignment, create a robust structural joint, and act to protect the radiator electronic hardware.

The flatness of the array plate 1000 to which the radiators are mounted determines the angles at which the RF waves are emitted to hold each array plate "flat" to a certain flatness tolerance to ensure the RF waves interfere constructively at the predetermined angles in front of the antenna array. Stacking multiple radar building blocks introduces a further challenge for this flatness requirement, as each individual array face needs to be precisely aligned with each other's faces to create one uniform, coplanar array face. An array plate is attached to a front of each modular antenna array block, and a plurality of interlocking joints a plurality of interlocking joints, such as a lap joint or tongue and groove features, positioned on top and bottom of the array plate are configured to allow for adjustment and alignment of said each modular antenna array block. For example, a built-in tongue-and-groove joint 1003 allows adjustment for this alignment. In some embodiments, the back of the radar building block can be manipulated to pivot the upper array plate on the lower one, thus achieving alignment.

Due to the proximity of the electronic hardware, there is a significant amount of weight load in the front of the array and the array plate 1000 functions as a load path for this weight load. The tongue-and-groove aspect of this joint acts to interlock each array plate to the one above/below it. This helps the interconnected array plates act like a monolithic structure that the load can pass through smoothly, without the use of fasteners. In addition, the tongue-and-groove aspect of this joint is designed such that the upper array 1010 can be assembled vertically to the lower array 1012, despite the arrays being tilted back at a significant angle, as illustrated in FIG. 10B.

In addition to the tongue and groove features, the array plate joints are castellated to match the radiator castellation. The array plate is designed such that the array plate will always lie proud of the radiators to prevent radiator-on-radiator contact during assembly and alignment, thus significantly reducing the risk of damaging a radiator.

Figure 11B:
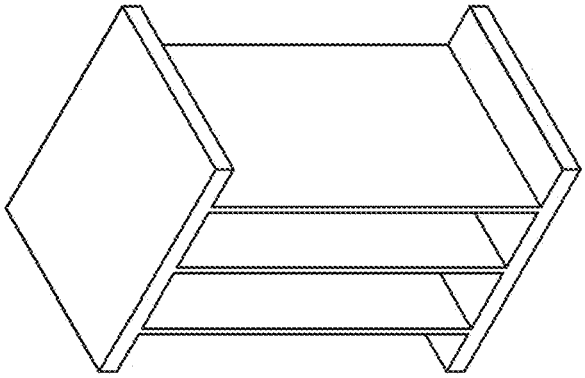
FIGS. 11A and 11B depict thermal support blocks for supporting the weight of the stacked radar structure, according to some embodiments of the disclosed invention.
Figure 11A:
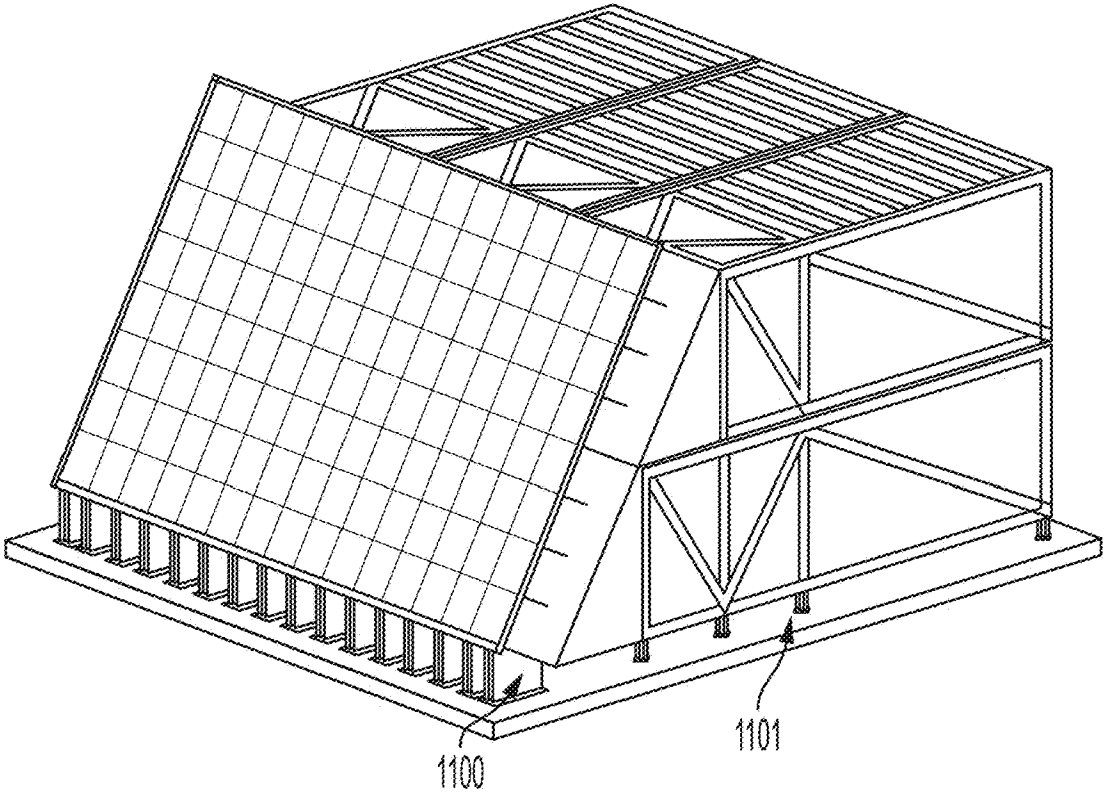

FIGS. 11A and 11B show thermal support blocks 1100 that support the weight of the stacked radar structure while allowing for deflections due to temperature fluctuation and differing thermal properties of the materials that make up the structure, according to some embodiments of the disclosed invention. The aluminum, steel, and concrete structures each have different coefficients of thermal expansion (CTE). This means that when there is a temperature change, either due to the external environment or in a situation where the radar is shut down for maintenance, each material will grow and shrink at a different rate. Therefore, the structure cannot be simply bolted to the ground, as those bolted joints would not withstand the stresses induced by these thermal deflections.

The thermal support blocks are designed such that they are compliant along one direction, and stiff in the other two directions. They are positioned such that the compliant direction of each block points directly at a single "thermal center" in the structure. In some embodiments, there are two types of thermal support blocks, the first design 1100, incorporates the array tilt angle to complete the load path through the array plate, and the second design 1101 is a simpler lattice structure that sits under the flat areas of the stacked radar structure. These blocks allow the stacked radar structure to deflect freely in the worst case thermal scenarios while maintaining their structure.

Figure 12B:
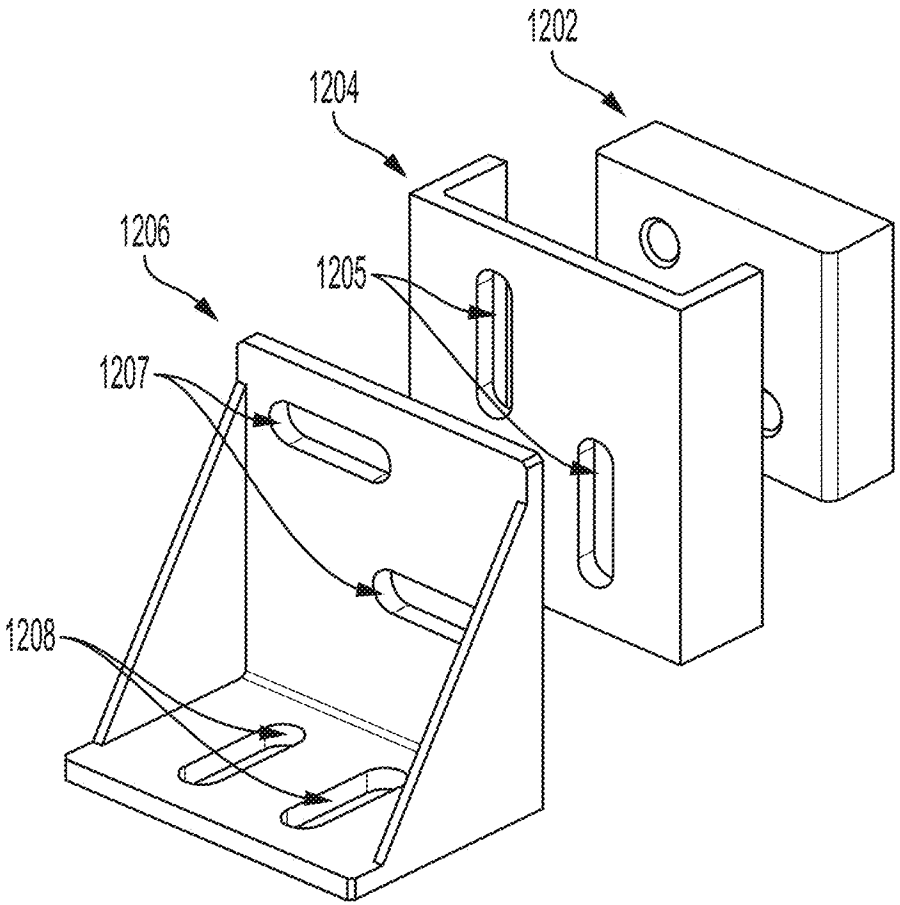
FIGS. 12A and 12B illustrate fasteners for misalignment compensation, according to some embodiments of the disclosed invention.
Figure 12A:
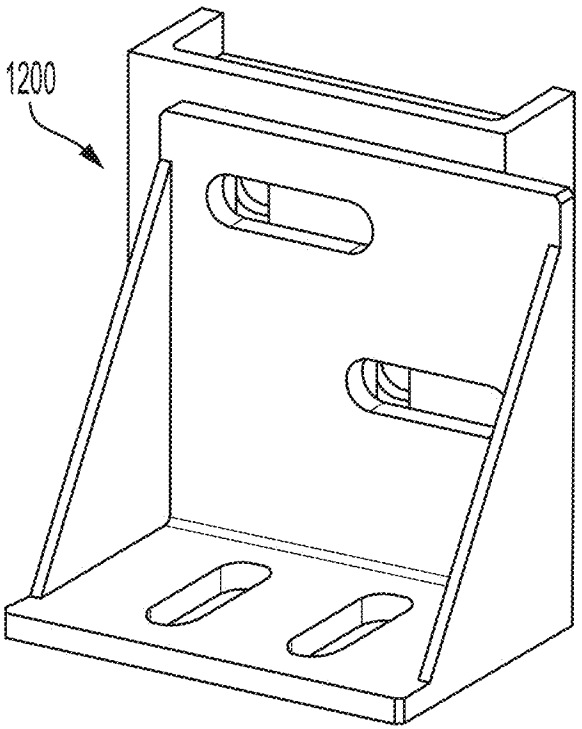

FIGS. 12A and 12B illustrate brackets 1200 configured to accommodate three degrees of freedom to compensate for alignment tolerances between the MRAs, according to some embodiments of the disclosed invention. Bracket locations are shown as 612*a* and 612*b* in FIG. 6C. The three part assembly includes a tapped block 1202, a slotted c-channel 1204, and a bi-axially slotted angle bracket 1206. Slotted c-channel 1204 is welded to the backend truss work of the stacked MRA. Tapped block 1202 provides vertical motion within the slots 1205 of c-channel 1204. Horizontal motion is achieved using the two slots 1207 in angle bracket 1206. Additionally, angle bracket 1206 has slots 1208 at the base to account for misalignment in that direction.

Figure 13B:
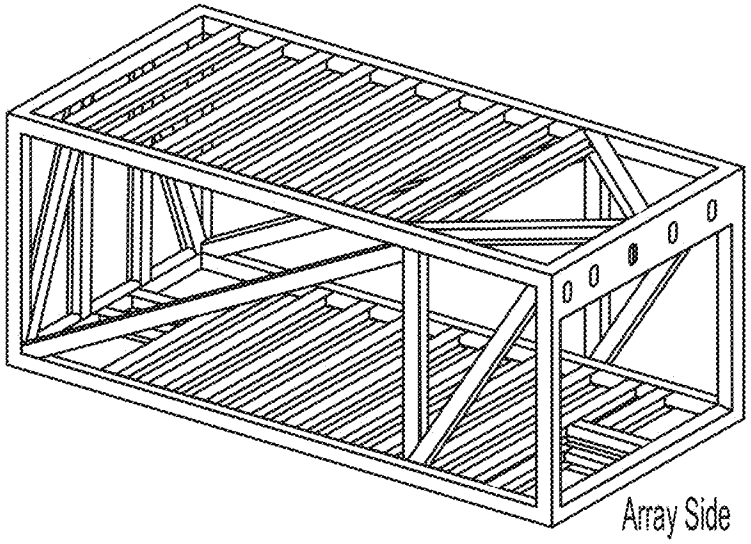
FIGS. 13A and 13B show an example for the size and construction of a back structure, according to some embodiments of the disclosed invention.
Figure 13A:
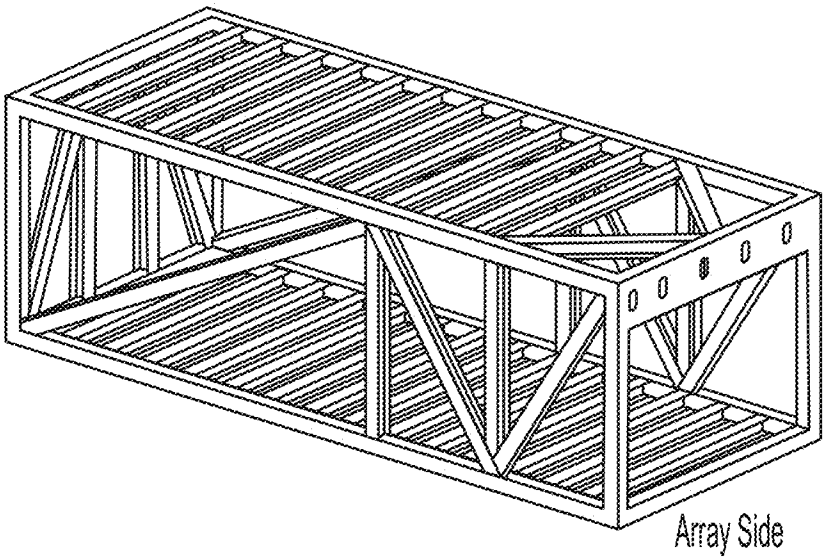

FIGS. 13A and 13B show examples for the size and construction of a back structure, according to some embodiments of the disclosed invention. FIG. 13A depicts a base stack and FIG. 13B illustrates a top stack. In some embodiments, both stacks are constructed out of structural steel and all joints and seams are continuously welded. This provides environmental sealing as well as EMI and High Altitude Electromagnetic Pulse (HEMP) shielding. The structure is designed to accommodate and allow access (after installation) to required alignment (jacking) and fixture points and meet static (e.g., being stacked) and dynamic (e.g., seismic and wind) load requirements.

Figure 14:
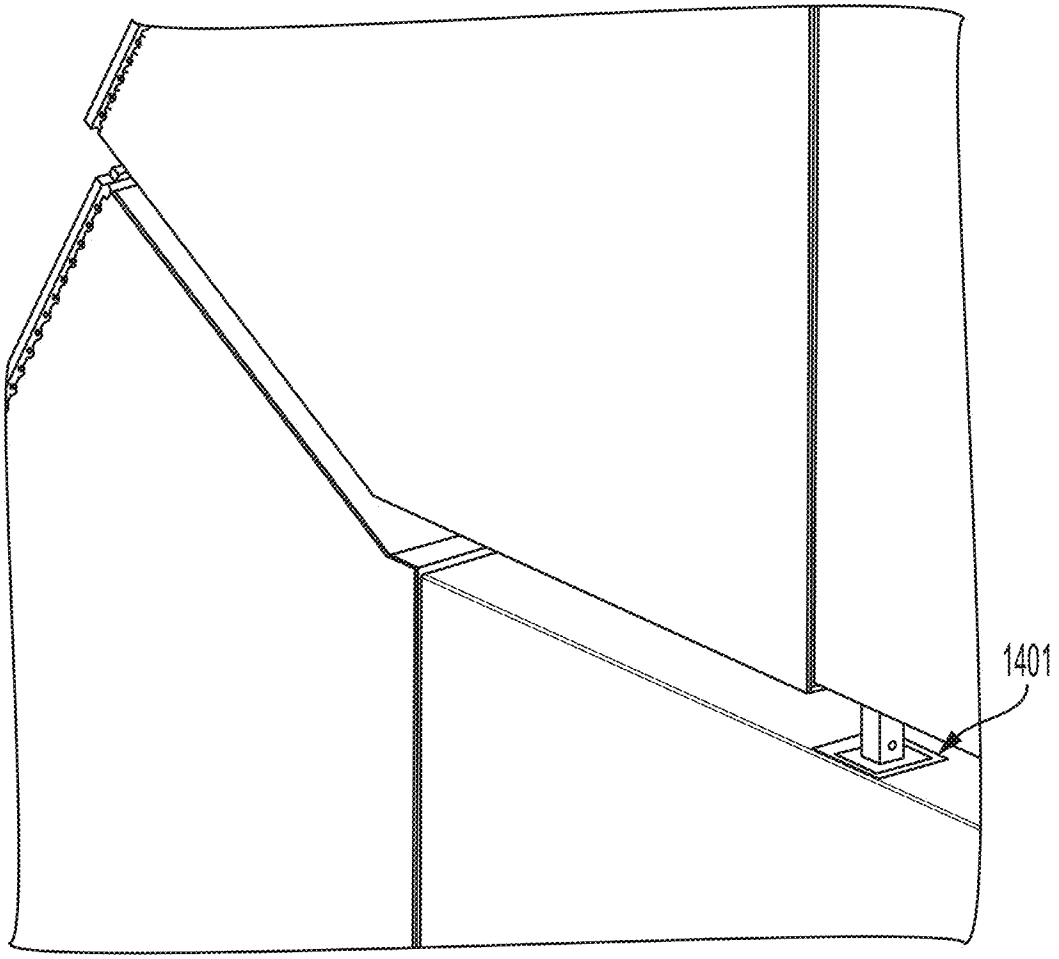
FIG. 14 shows pads mounted underneath vertical adjustment actuators to facilitate sliding, according to some embodiments of the disclosed invention.

FIG. 14 shows pads mounted underneath vertical adjustment jacks to facilitate sliding, according to some embodiments of the disclosed invention. As shown, pads 1401, which may be made of low friction material, such as Delrin™, are mounted underneath vertical adjustment jacks to facilitate sliding of one MRA relative to another. This low friction interface significantly reduces the force required to move one radar building block structure relative to another, therefore allowing for more precise adjustments.

Figure 15:
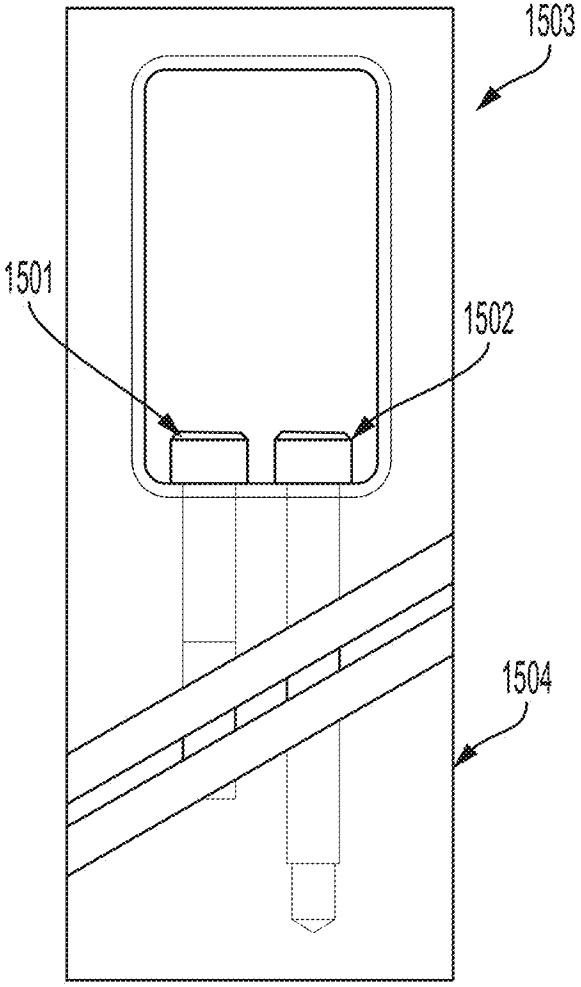
FIG. 15 shows a bolted interface between an upper radar building block structure and a lower radar building block structure, according to some embodiments of the disclosed invention.

FIG. 15 shows a bolted interface between an upper radar building block structure/frame and a lower radar building block structure/frame, according to some embodiments of the disclosed invention. As depicted, the bolt interface includes a compression bolt 1501 and a tension bolt 1502. The compression bolt 1501 threads through a tapped hole in the upper MRA structure 1503 and bottoms out on a hard point in the bottom MRA structure 1504. This bolt provides a load path through the radar structures and maintains the required gap between bottom and top structures. The tension bolt 1502 has a clearance hole in the upper structure 1503 and a tapped hole in the lower structure 1504. This bolt is configured to draw and keep the structures/frames together and keep them from separating.

The architecture of the disclosed invention enables stacking and assembling radar building blocks together vertically and/or horizontally to form a larger and higher performance radar system, which can at a later date become larger by adding additional building blocks to increase capability, minimize radar down time while growing to the larger sizes, and deploy radar systems rapidly to acquire available critical equipment as soon as possible.

The approach of the disclosed invention allows the radar system to be modular and scalable at the array level. The radar module assembly section becomes the basic building block, containing all of the antenna's electronic hardware and functionality including the radiators, beamformers, TRIMMs, DREXs, and power conversion. Once assembled, they combine to become the full size radar antenna array as well as a self-supporting structural building block. Each module building block receives coolant, power, and control signals in parallel and is a stand-alone mini-radar. The individual building blocks can be integrated with electronics and tested off-site, then shipped to the deployment region for installation.

Once at the deployment site, the building blocks can be assembled vertically and horizontally as they arrive and be aligned into proper positions to create the full size radar antenna array. This minimizes initial cost while maintaining the ability to upgrade capability when needed. The approach also minimizes radar down time while it is being grown to a larger sizes, which is a key requirement for tactically critical equipment. The radar system can also be deployed faster than systems where all electronics are integrated on-site and thus reducing the time it takes to get critical equipment available since the building blocks are delivered to the deployment site as tested known-good equipment.

It will be recognized by those skilled in the art that various modifications may be made to the illustrated and other embodiments of the invention described above, without departing from the broad inventive step thereof. It will be understood therefore that the invention is not limited to the particular embodiments or arrangements disclosed, but is rather intended to cover any changes, adaptations or modifications which are within the scope of the invention as defined by the appended drawings and claims.

The invention claimed is:

1. A modular phased array antenna comprising:

a plurality of modular antenna array blocks assembled together as a single antenna array, wherein each modular antenna array block includes:

a plurality of transmit/receive integrated multichannel module (TRIMM) cards, each TRIMM card including power conversion and beamforming circuits, wherein power and control signals are connected in parallel to each modular antenna array, a plurality of radiators for radiating antenna signals and collectively having a radiator face, a radome integrated with the plurality of radiators and attached directly to the radiator face, wherein a surface of the radome does not extend beyond the radiator face, and a frame for supporting the TRIMM cards; and an array face in a same direction as the radiator faces and comprising an array plate, radiators and the radome for each modular antenna array block, wherein radomes for the plurality of modular antenna array blocks are interlocked and aligned adjacent to each other to create a single monolithic array face for the modular phased array antenna.

2. The modular phased array antenna of claim 1, wherein each modular antenna array block receives cooling independent with respect to cooling of other modular antenna array blocks.

3. The modular phased array antenna of claim 1, wherein the frame is made of aluminum and attaches to a back structure made of steel on its back side.

4. The modular phased array antenna of claim 3, wherein electronics for the power and beamforming signals reside in the back structure to further allow a modular antenna array block to be assembled on top of or next to another modular antenna array block to create a single, larger antenna array.

5. The modular phased array antenna of claim 3, wherein each modular antenna array block further comprises an intermediate aluminum frame between the frame and the back structure to minimize array face distortion due to coefficient of thermal expansion.

6. The modular phased array antenna of claim 3, wherein each modular antenna array block further comprises a modular and replaceable rack for accommodating the electronics for the power and beamforming signals resides in the back structure.

7. The modular phased array antenna of claim 3, wherein each modular antenna array block further comprises a flanged interface to provide a physical interface between the frame and the back structure, while allowing access forward to the MRA housing which supports and aligns the MRAs.

8. The modular phased array antenna of claim 1, wherein each modular antenna array block further comprises a plurality of adjustment mechanisms for adjustment of said each modular antenna array building block in six degrees of freedom.

9. The modular phased array antenna of claim 1, wherein each modular antenna array block further comprises threaded bosses along vertical sides and bottom of the frame for allowing said each modular antenna array block to be securely fastened to every adjacent modular antenna array block.

10. The modular phased array antenna of claim 9, wherein the threaded bosses are configured to be rotated until snug against the frame of every adjacent modular antenna array block and include a bolt placed thru a center hole in each threaded boss threaded into said every adjacent modular antenna array block to securely attach said every adjacent modular antenna array block.

11. The modular phased array antenna of claim 1, wherein each modular antenna array block further comprises a plurality of actuators configured to adjust a position of said each modular antenna array block.

12. The modular phased array antenna of claim 1, wherein each modular antenna array block further comprises a plurality of interlocking joints with a plurality of interlocking joints positioned in top and bottom of the array plate configured to allow for adjustment and alignment of said each modular antenna array block.

13. The modular phased array antenna of claim 1, further comprising a bolted interface between an upper modular frame and a lower modular frame, wherein the bolt interface includes a compression bolt and a tension bolt, wherein the compression bolt threads through a tapped hole in the upper modular frame to provide a load path through the upper and lower modular frames and maintains the required gap between bottom and top structures, and wherein the tension bolt includes a clearance hole in the upper modular frame and a tapped hole in the lower modular frame to keep the upper modular frame and the lower modular frame together.

14. The modular phased array antenna of claim 1, wherein each modular antenna array block further comprises a Digital Receiver Exciter (DREX) distributed in said each modular antenna array block.

15. A modular phased array antenna comprising:

a plurality of modular antenna array blocks interlocked and attached together as a single antenna array, wherein the modular antenna array blocks are attached with no interruptions in the block spacing between adjacent stacked modular antenna array blocks, and wherein each modular antenna array block includes:

a plurality of transmit/receive integrated multichannel module (TRIMM) cards, each TRIMM card including power and beamforming signals, wherein power and beamforming signals are connected in parallel to each modular antenna array block, a plurality of radiators for radiating antenna signals collectively having a radiator face, a radome integrated with the plurality of radiators and attached directly to the radiator face, wherein the radome does not extend beyond the radiator face and fits within the modular antenna array blocks to enable the modular antenna array blocks to be stacked with no interruptions in the block spacing between adjacent stacked modular antenna array building, and a frame for supporting the TRIMM cards.

16. The modular phased array antenna of claim 15, wherein each modular antenna array block receives cooling independent with respect to cooling of other modular antenna array blocks.

17. The modular phased array antenna of claim 15, wherein the frame is made of aluminum and attaches to a back structure made of steel on its back side, and each modular antenna array block further comprises an intermediate aluminum frame between the frame and the back structure to minimize array face distortion due to coefficient of thermal expansion.

18. The modular phased array antenna of claim 15, wherein each modular antenna array block further comprises a plurality of adjustment mechanisms located at corners of said each modular antenna array building block for adjustment of said each modular antenna array building block in six degrees of freedom.

19. The modular phased array antenna of claim 15, wherein each modular antenna array block further comprises threaded bosses along vertical sides and bottom of the frame for allowing said each modular antenna array block to be securely fastened to every adjacent modular antenna array block.

20. The modular phased array antenna of claim 15, wherein each modular antenna array block further comprises a plurality of actuators configured to adjust a position of said each modular antenna array block.

* * * * *